US005791244A

United States Patent [19]

Tognino

[11] Patent Number: 5,791,244

[45] Date of Patent: Aug. 11, 1998

[54] DEVICE FOR APPLYING A PRINTING BLANKET TO A BLANKET CYLINDER OF A ROTARY PRINTING PRESS

[75] Inventor: Michael Tognino, Walldorf, Germany

[73] Assignee: Heidelberger Druckmaschinen AG, Heidelberg, Germany

[21] Appl. No.: 786,859

[22] Filed: Jan. 22, 1997

[30] Foreign Application Priority Data

Jan. 22, 1996 [DE] Germany ..... 196 02 102.2

[51] Int. Cl.[6] ..... B41F 27/12

[52] U.S. Cl. ..... 101/415.1

[58] Field of Search ..... 101/415.1, 410, 101/412, 409, 378

[56] References Cited

U.S. PATENT DOCUMENTS

| | | | |
|---|---|---|---|
| 3,276,364 | 10/1966 | Langer | 101/415.1 |
| 3,296,673 | 1/1967 | Kirkpatrick | 101/415.1 |
| 4,030,415 | 6/1977 | Fellows | 101/382.1 |
| 4,515,375 | 5/1985 | Bleckmann et al. | 101/415.1 |
| 4,854,237 | 8/1989 | Theilacker | 101/415.1 |
| 4,934,714 | 6/1990 | Lynch | 277/1 |
| 5,131,326 | 7/1992 | Wrzesinski | 101/415.1 |
| 5,241,905 | 9/1993 | Guaraldi et al. | 101/216 |
| 5,329,853 | 7/1994 | Stegmeir et al. | 101/415.1 |

FOREIGN PATENT DOCUMENTS

| | | | |
|---|---|---|---|
| 186648 | 8/1956 | Austria | 101/415.1 |
| 1 075 635 | 2/1960 | Germany . | |
| 73 328 | 5/1970 | Germany . | |
| 25 42 748 | 4/1976 | Germany . | |
| 34 33 045 A1 | 3/1986 | Germany . | |
| 43 32 364 C2 | 4/1994 | Germany . | |
| 43 41 246 C1 | 2/1995 | Germany . | |
| 44 04 758 A1 | 8/1995 | Germany . | |
| 467 158 | 2/1969 | Switzerland . | |
| 666356 | 2/1952 | United Kingdom | 101/415.1 |
| 1010720 | 11/1965 | United Kingdom | 101/415.1 |
| 1192209 | 5/1970 | United Kingdom | 101/415.1 |

*Primary Examiner*—Edgar S. Burr
*Assistant Examiner*—Leslie Grohusky
*Attorney, Agent, or Firm*—Herbert L. Lerner; Laurence A. Greenberg

[57] ABSTRACT

A device for axially applying a printing blanket to a cylinder of a rotary printing press having a tensioning device formed with an axially extending receiving channel, the cylinder being formed at an end face thereof with an opening offering axial access to the tensioning device, includes respective insert strips disposed at leading and trailing edges of the printing blanket, the insert strips being connectable to one another outside the cylinder.

11 Claims, 5 Drawing Sheets

DEVICE FOR APPLYING A PRINTING BLANKET TO A BLANKET CYLINDER OF A ROTARY PRINTING PRESS

BACKGROUND OF THE INVENTION

Field of the Invention

The invention relates to a device for applying a printing blanket to a blanket cylinder of a rotary printing press. From the published German Patent Document DE 44 04 758 A1, it has become known heretofore to apply finite rubber blankets axially onto a blanket cylinder of a rotary printing press. In this regard, a plastically deformable printing blanket is manually bent in a circle beforehand, analogous to the shape of the cylinder, and the bent ends of the cloth are then slid into a longitudinal slit formed in the cylinder.

SUMMARY OF THE INVENTION

It is accordingly an object of the invention to provide a device for applying a conventional printing blanket to a blanket cylinder of a rotary printing press even when the cylinder gap opening formed in the blanket cylinder is extremely narrow.

With the foregoing and other objects in view, there is provided, in accordance with the invention, a device for axially applying a printing blanket to a cylinder of a rotary printing press having a tensioning or clamping device formed with an axially extending receiving channel, the cylinder being formed at an end face thereof with an opening offering axial access to the tensioning device, comprising respective insert strips disposed at leading and trailing edges of the printing blanket, the insert strips being connectable to one another outside the cylinder.

In accordance with another feature of the invention, the printing-blanket applying device includes a connecting rail into which the insert strips are insertable.

In accordance with a further feature of the invention, one of the insert strips is magnetic and the respective other of the strips is magnetizable.

In accordance with an added feature of the invention, the receiving channel of the tensioning device has a cross section having a width at a bottom thereof which is greater than a width at a top opening thereof.

In accordance with an additional feature of the invention, the printing-blanket applying device includes a connecting rail receivable in the receiving channel of the tensioning device, the connecting rail being formed with a receiving channel having a contour adapted to the contour of the receiving channel of the tensioning device.

In accordance with yet another feature of the invention, the connecting rail has an outer contour adapted to a contour of the receiving channel of the tensioning device.

In accordance with yet a further feature of the invention, the receiving channel formed in the connecting rail has a trapezoidal cross section.

In accordance with yet an added feature of the invention, the printing-blanket applying device includes a frustoconical hollow body cooperating with the cylinder as a blanket mounting aid therefor.

In accordance with yet an additional feature of the invention, the frustoconical hollow body is cylindrical in an axial extension of the greatest diameter thereof.

In accordance with another feature of the invention, the hollow body, at the outer peripheral surface thereof, is formed with an axially extending infeed channel open at an end face thereof.

In accordance with a concomitant feature of the invention, the infeed channel has a cross-sectional contour corresponding to the contour of the receiving channel of the tensioning device.

A particular advantage of the invention is that a narrow cylinder channel may be formed in the blanket cylinder, which does not have to be wider than twice the thickness of a rubber blanket to be applied to the blanket cylinder.

The advantage of providing narrow cylinder channels, particularly in the case of web-fed rotary printing presses, is that the surface area of the unprinted regions becomes smaller, thus making a drastic reduction in paper consumption possible. Understandably, reducing the cylinder channel width of the blanket cylinder beyond an amount of the cylinder channel width of the plate cylinder which cooperates with the respective blanket cylinder brings with it no further savings effect.

In an exemplary embodiment, the receptacle for the connecting piece for the respective ends of the printing blanket, for example, for the insert strips mounted thereon, is constructed so that the insert strips are prevented from falling radially out of the connecting piece.

If the receptacle for the connecting piece is simultaneously embodied in the tensioning or clamping rail, then the correspondingly adapted connecting piece is likewise secured against falling out of the tensioning or clamping rail. As a result of this provision, it is possible to place the printing blanket in any arbitrary position on the blanket cylinder or remove it from any arbitrary position thereon.

In a further feature of the invention, at least one of the surfaces of the reinforcements which engage one another in the installed state is magnetic, preferably permanently magnetic, while the respective other surfaces are magnetizable. By this provision, the connecting element can be dispensed with.

To provide the substantially flexible printing blanket with a circularly preshaped form adapted to the circumference of the cylinder, which facilitates the application thereof on the cylinder, a mounting or assembly aid is provided. This aid is preferably constructed as a frustoconical hollow body and can be disposed at one end face of the blanket cylinder. A circumference of the mounting aid at the end face of the blanket cylinder is thereby at least as large as the circumference of the blanket cylinder.

Advantageously, the invention can be used both for a blanket cylinder, as well as for other cylinders not directly involved in the printing, such as impression cylinders, for example.

Other features which are considered as characteristic for the invention are set forth in the appended claims.

Although the invention is illustrated and described herein as embodied in a device for applying a printing blanket to a blanket cylinder of a rotary printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
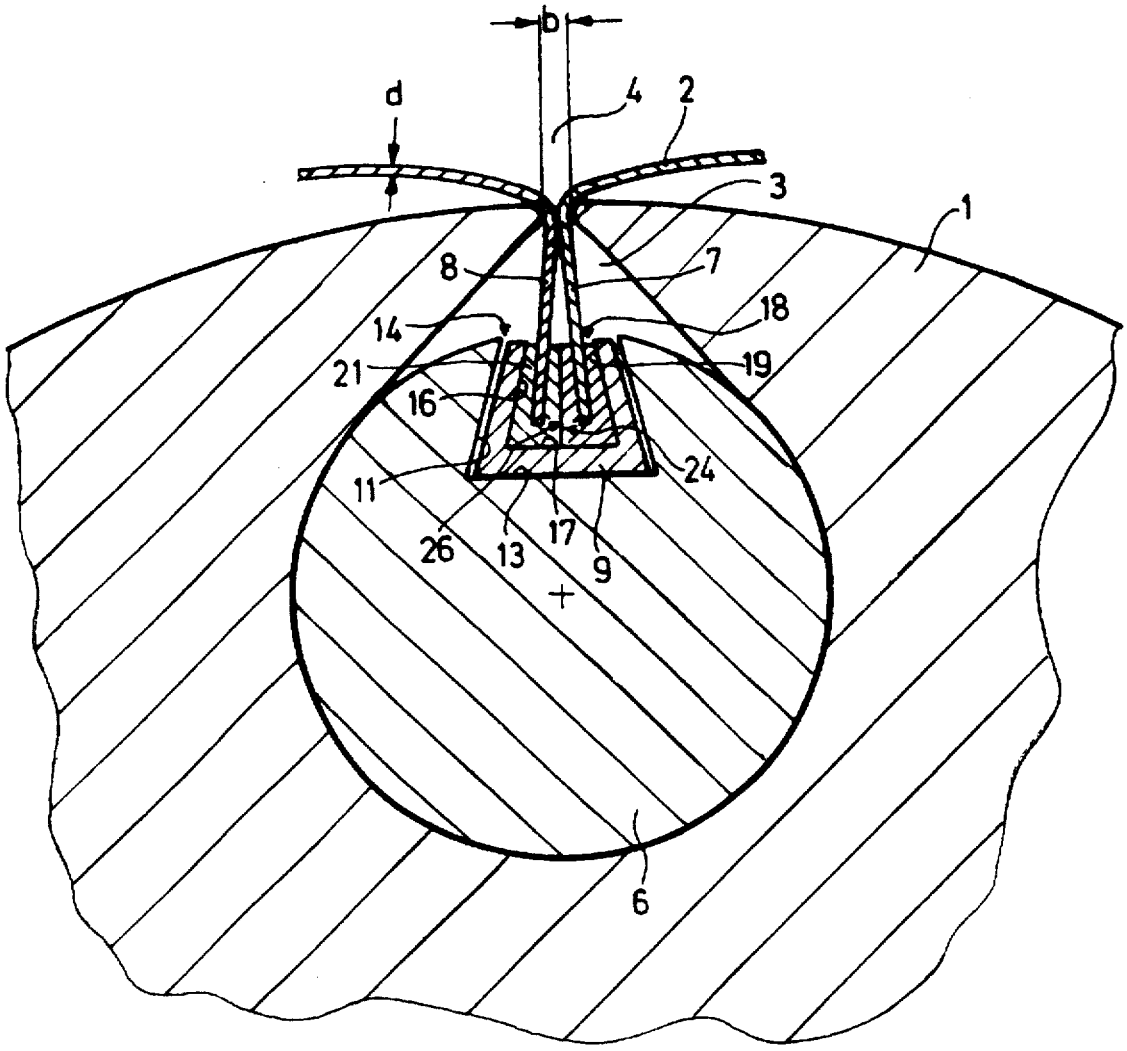
FIG. 1 is a fragmentary diagrammatic cross-sectional view of a blanket cylinder provided with a first embodiment of a device for applying a printing blanket thereto in accordance with the invention, which includes a holding device for a printing blanket, the holding device being inserted into a tensioning, clamping or lock-up device.
Figure 2:
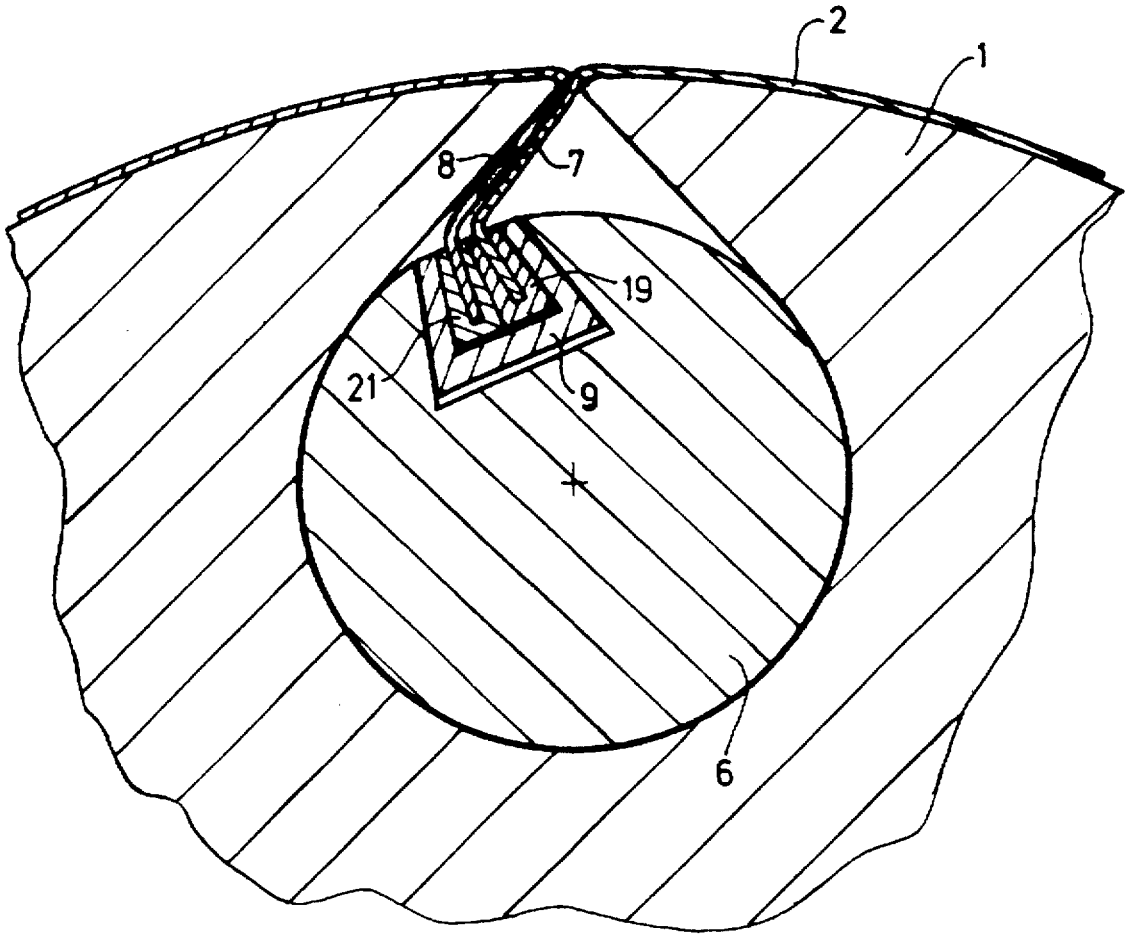
FIG. 2 is a view like that of FIG. 1, showing the holding and lock-up devices in a different operating phase thereof wherein the printing blanket is in a tension-loaded state.
Figure 3:
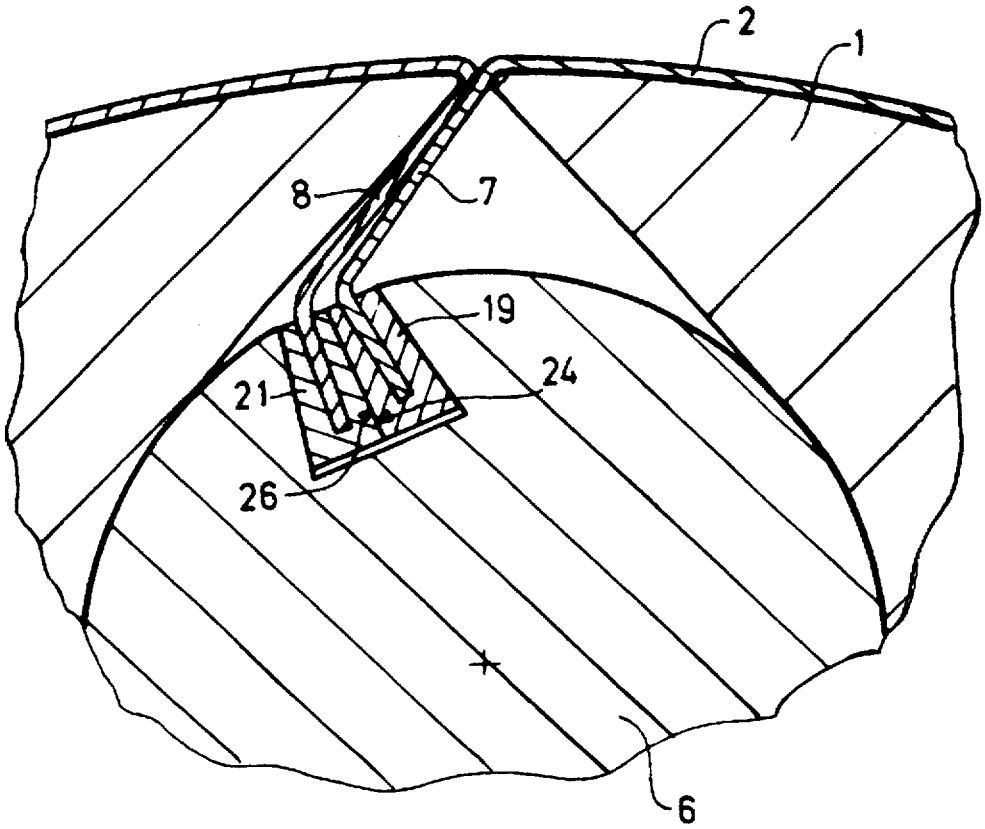
FIG. 3 is a view like that of FIG. 2 of a second exemplary embodiment of the device according to the invention including a different device for connecting the insert strips of the printing blanket.

Referring now to the drawings and, first, particularly to FIGS. 1 to 3 thereof, there is shown therein, in a rotary printing press, in particular, a sheet-fed rotary printing press, among other elements, a cylinder 1 on the circumference or outer cylindrical surface of which a printing blanket 2 is fastened. To that end, an axially extending cylinder channel 3 is provided in the blanket cylinder 1 and formed with an opening or gap 4 at the circumference or outer cylindrical surface of the cylinder 1. The opening or gap 4 has a width b, as viewed in the circumferential direction of the cylinder 1, which is at least twice as large as the thickness d of the printing blanket.

A tensioning, clamping or lock-up device 6 for the printing blanket 2 is disposed in the cylinder channel 3. The tensioning or clamping device 6, in the exemplary embodiment shown, is a rotatably supported tensioning or clamping shaft. In a different, non-illustrated embodiment of the invention, the tensioning, clamping or lock-up device may also be a radially movable clamping strip.

The tensioning, clamping or lock-up shaft 6 for receiving the printing blanket ends, i.e., the leading and trailing edges 7 and 8, respectively, of the printing blanket 2 or of a connecting piece 9 which holds the ends 7 and 8 of the printing blanket 2 together, is formed with an axially extending receiving channel 11. The receiving channel 11 is formed at a side thereof facing towards a side wall 12 (FIG. 4) of the printing press so as to be freely accessible and so that the connecting piece 9 in the form of a rail can be inserted axially into the receiving channel 11 of the tensioning or clamping shaft 6. The side wall 12 is not shown in FIG. 1 but is located in front of the plane of FIG. 1. The receiving channel 11 of the tensioning or clamping shaft 6 has a trapezoidal cross section, which is wider at the bottom 13 of the receiving channel 11 than at the opening 14 thereof. The rail 9 has a trapezoidal cross section adapted to the inside contour of the receiving channel 11; a receiving channel 16 formed in the rail 9 likewise has a trapezoidal cross section, the width of which at the bottom 17 of the receiving channel 16 is wider than at the opening 18.

For stabilizing the rubber blanket ends 7 and 8, they are provided with insert strips, so-called reinforcements 19 and 21 which, with lateral opposing faces 24 and 26 thereof, which are disposed against one another, likewise have a trapezoidal cross section. The insert strips 19 and 21 are formed thicker than the printing blanket.

In the preferred exemplary embodiment, the cross sections of the printing blanket securing devices, such as the reinforcements 19 and 21, the rail 9 and the receiving channel 11, are trapezoidal. It is readily apparent, however, that other cross sections, such as round, polygonal, or cruciform cross sections, for example, are also realizable.

In a second exemplary embodiment shown in FIG. 3, one of the lateral faces 24 and 26 of the insert strips 19 and 21, respectively, is magnetic while the other is magnetizable, so that, on being placed together, these faces are held together by magnetic forces. In this embodiment, the insertion of the rail 9 can be omitted.

Figure 4:
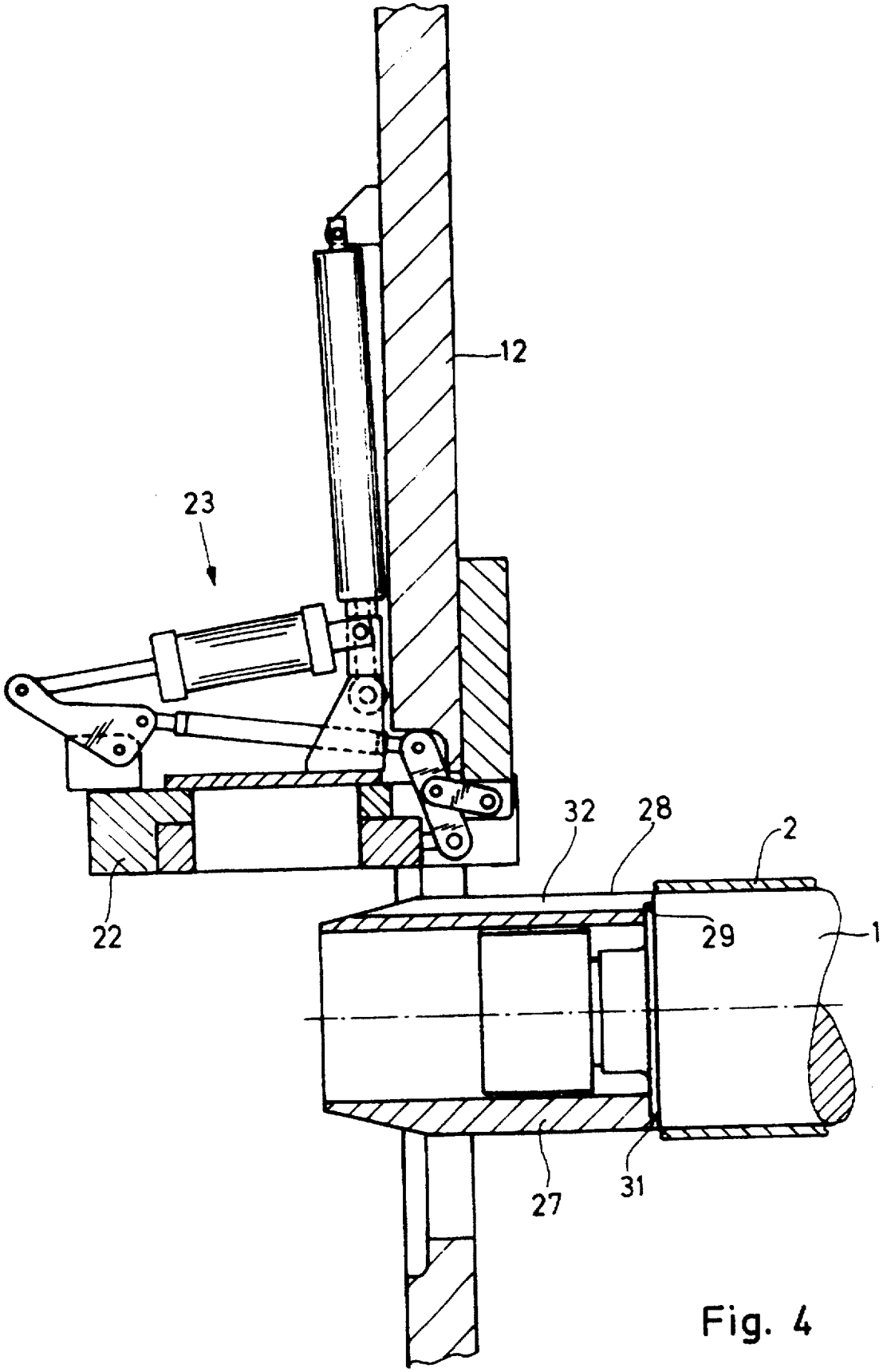
FIG. 4 is a fragmentary longitudinal sectional view of a blanket cylinder with a releasable bearing fastening device.

To enable the rubber blanket ends 7 and 8 to be inserted axially into the receiving channel 11 formed in the tensioning or clamping shaft 6, the cylinder 1 has a releasable bearing fastening device of the type heretofore known, for example, from the published German Patent Document DE 43 32 364 C2 and shown in FIG. 4. Provided in FIG. 4 is the side wall 12 having a mounting or assembly door 22 which is disposed swivelably on the side wall 12 and is swivelable by an adjusting device 23 out of a "closed" position, wherein it closes a corresponding opening formed in the side wall 12, and into an "opened" position, wherein the opening formed in the side wall 12 is open as shown in FIG. 4, and back again.

In the "opened" position of the door 22, free access to the end face of the cylinder 1 and to the receiving channel 11 of the tensioning or clamping shaft 6 is provided.

To fasten the printing blanket 2 onto the cylinder 1, the printing blanket ends 7 and 8, which are preferably provided with the insert strips or so-called reinforcements 19 and 21, are first thrust axially into the rail 9 (note FIG. 1, for example). Next, the thus mutually connected printing blanket ends 7 and 8 are slid or thrust together with the rail 9 axially into the receiving channel 11 of the tensioning or clamping shaft 6, until a non-illustrated releasable lock secures the rail 9 and the printing blanket ends 7 and 8 disposed therein against axial displacement. The printing blanket 2 is passed through the cylinder channel opening or gap 4 and wrapped around the circumference or outer cylindrical surface of the cylinder 1. Thereafter, the tensioning, clamping or lock-up shaft 6 is swiveled clockwise or counterclockwise, until the printing blanket 2 rests with the desired tension on the circumference or outer cylindrical surface of the cylinder 1.

To facilitate the application of the printing blanket 2 onto the cylinder 1, a mounting or assembly aid is provided, in the form of a frustoconical hollow body 27. This body 27 is formed with an outer cylindrical surface or circumference 28 in the vicinity of the end face of the cylinder 1, which is at least as large as the circumference of the cylinder 1. For holding and supporting, respectively, the hollow body 27, an encompassing or surrounding shoulder 29, which can be slipped onto a shaft stub 31 of the cylinder 1, is provided on the hollow body 27. The hollow body 27 is formed with an axially extending infeed channel 32 on the circumference thereof, which is open at the end faces. The cross section of the infeed channel 32 matches the cross section of the receiving channel 11 which, for example, is trapezoidal.

Figure 5:
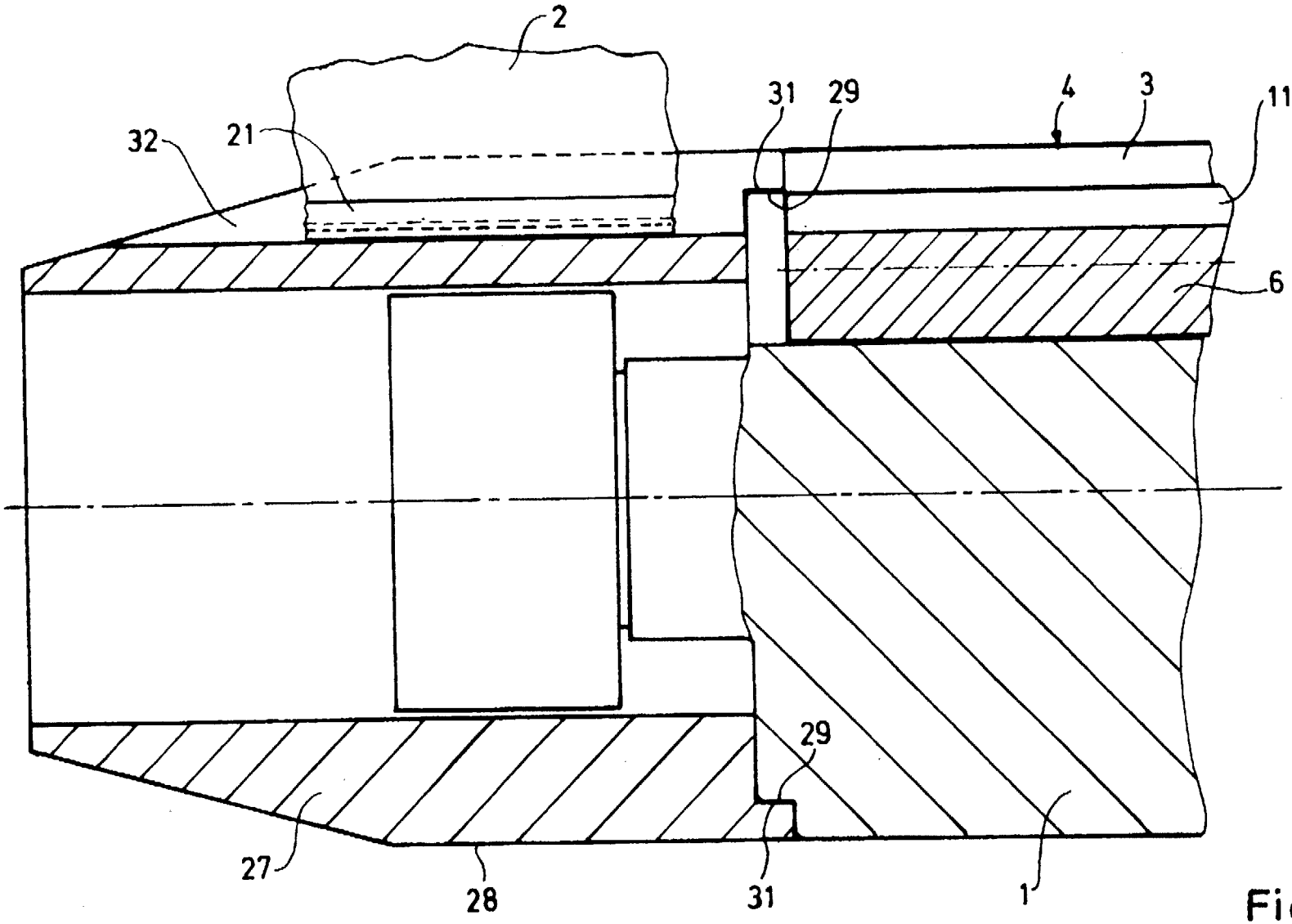
FIG. 5 is an enlarged fragmentary view of FIG. 4 showing the blanket cylinder with an aiding or auxiliary device for axially applying a printing blanket thereon.

For mounting or assembly purposes, as shown in FIG. 5, the hollow body 27 is slipped onto the shaft stub 31, and the infeed channel 32 is made to coincide with the receiving channel 11. A suitable detent for fixing the correct rotary position of the hollow body 27 relative to the cylinder 1 may be provided. Then, the rail 9 together with the rubber blanket ends 7 and 8 is inserted axially, initially into the infeed channel 32 and from there into the receiving channel 11.

I claim:

1. In combination, a cylinder of a rotary printing press, comprising:

a cylinder body having a tensioning device formed with an axially extending receiving channel and an end face, said cylinder body being formed at said end face thereof with an opening offering axial access to said tensioning device, and a device for mounting a printing blanket to said cylinder body, comprising:

respective insert strips disposed at leading and trailing edges of the printing blanket, and means connecting said insert strips connected to one another outside said cylinder body for axial insertion into said cylinder body.

2. The printing-blanket applying device according to claim 1, wherein said means connecting said insert strips includes a connecting rail into which said insert strips are insertable.

3. The printing-blanket applying device according to claim 2, wherein said connecting rail has an outer contour substantially matching a contour of said receiving channel of said tensioning device.

4. The printing-blanket applying device according to claim 1, wherein said receiving channel of said tensioning device has a cross section having a width at a bottom thereof which is greater than a width at a top opening thereof.

5. The printing-blanket applying device according to claim 4, wherein said means connecting said insert strips includes a connecting rail receivable in said receiving channel of said tensioning device, said connecting rail being formed with a receiving channel having a contour substantially matching the contour of said receiving channel of said tensioning device.

6. The printing-blanket applying device according to claim 5, wherein said receiving channel formed in said connecting rail has a trapezoidal cross section.

7. The printing-blanket applying device according to claim 1, wherein said means connecting said insert strips is defined by one of said insert strips being magnetic and the respective other of said strips being magnetizable for connecting said one of said insert strips to said other of said strips.

8. The printing-blanket applying device according to claim 1, including a frustoconical hollow body removably attachable to said cylinder body as a blanket mounting aid therefor.

9. The printing-blanket applying device according to claim 8, wherein said frustoconical hollow body is cylindrical in an axial extension of the greatest diameter thereof.

10. The printing-blanket applying device according to claim 8, wherein said hollow body at the outer peripheral surface of said hollow body is formed with an axially extending infeed channel open at an end face of said hollow body.

11. The printing-blanket applying device according to claim 10, wherein said infeed channel has a cross-sectional contour corresponding to the contour of said receiving channel of said tensioning device.

* * * * *